US008491723B2

(12) United States Patent
Lehmann

(10) Patent No.: US 8,491,723 B2
(45) Date of Patent: Jul. 23, 2013

(54) METHOD FOR SELF-CLEANING OF A CONTINUOUS DISHWASHER

(75) Inventor: Denis Lehmann, Ortenberg (DE)

(73) Assignee: Meiko Maschinenbau GmbH & Co. KG, Offenburg (DE)

( * ) Notice: Subject to any disclaimer, the term of this patent is extended or adjusted under 35 U.S.C. 154(b) by 0 days.

(21) Appl. No.: 12/843,303

(22) Filed: Jul. 26, 2010

(65) Prior Publication Data

US 2011/0017234 A1 Jan. 27, 2011

Related U.S. Application Data

(63) Continuation of application No. PCT/EP2008/008807, filed on Oct. 17, 2008.

(30) Foreign Application Priority Data

Jan. 24, 2008 (DE) ..... 10 2008 005 876

(51) Int. Cl.
*B08B 7/04* (2006.01)
*B08B 7/00* (2006.01)
*B08B 3/00* (2006.01)

(52) U.S. Cl.
USPC ..... 134/22.18; 134/10; 134/18; 134/25.2; 134/34; 134/36

(58) Field of Classification Search
USPC ..... 134/25.2, 25.1, 18, 34, 36, 22.1, 134/22.18, 10, 57 D, 56 D, 58 D, 67, 70, 134/72, 104.2, 104.4, 110, 111
See application file for complete search history.

(56) References Cited

U.S. PATENT DOCUMENTS

| | | | | |
|---|---|---|---|---|
| 4,805,649 | A * | 2/1989 | Nezworski | 134/57 R |
| 2006/0180179 | A1* | 8/2006 | Roderer et al. | 134/18 |
| 2008/0041419 | A1 | 2/2008 | Gaus | |
| 2009/0211611 | A1* | 8/2009 | Berner et al. | 134/48 |
| 2011/0017234 | A1* | 1/2011 | Lehmann | 134/10 |

FOREIGN PATENT DOCUMENTS

| | | | |
|---|---|---|---|
| DE | 41 00 164 | C1 | 4/1992 |
| DE | 92 09 022 | U1 | 10/1992 |
| DE | 103 57 256 | B3 | 6/2005 |
| DE | 10 2005 008 987 | B3 | 6/2006 |
| EP | 0 560 025 | A1 | 9/1993 |

* cited by examiner

*Primary Examiner* — Alexander Markoff
(74) *Attorney, Agent, or Firm* — Muncy, Geissler, Olds & Lowe, PLLC

(57) ABSTRACT

A method for an automated self-cleaning of a continuous dishwasher for items to be cleaned with at least one rinsing zone, at least one clear rinsing zone and also a transporter. Items to be cleaned are conveyed in the direction of transportation via the transporter. The continuous dishwasher comprises at least one fine filter with a back-rinser on at least one storage tank and also at least one device for emptying each of the storage tanks. The continuous dishwasher automatically carries out a self-cleaning cycle in which cleaning liquid located in each of the storage tanks is used several times in succession in the various zones for cleaning thereof. The cleaning liquid is circulated by means of circulating pumps in the respective storage tanks and supplied to spraying systems, which are already present in the respective zones, or to separate nozzles or nozzle heads for wetting the inner side of the faces delimiting the respective zone.

7 Claims, 5 Drawing Sheets

METHOD FOR SELF-CLEANING OF A CONTINUOUS DISHWASHER

This nonprovisional application is a continuation of International Application No. PCT/EP2008/008807, which was filed on Oct. 17, 2008, and which claims priority to German Patent Application No. DE 10 2008 005 876.9, which was filed in Germany on Jan. 24, 2008, and which are both herein incorporated by reference.

BACKGROUND OF THE INVENTION

1. Field of the Invention

The invention relates to a method for the self-cleaning of a cleaning machine, in particular a continuous dishwasher for items to be cleaned, such as for example crockery.

2. Description of the Background Art

Cleaning machines, in particular continuous dishwashers, which are used for example for cleaning the crockery, tray and container parts to be cleaned that arise in communal catering, are known. Whereas dishwashing devices for the domestic sector generally pass through a program sequence with the successive cleaning steps in a stationary arrangement of the crockery and cutlery parts to be cleaned, the treatment zones in continuous dishwashers are arranged one after another and the items for rinsing or the items to be cleaned are transported by means of a conveyor from the loading region (inlet region), through treatment zones to be passed through in succession, to the removal region (outlet region).

Continuous dishwashers known in the prior art generally have four different treatment zones between the inlet region and outlet region. A conveyor conveys the items for rinsing through the individual treatment zones. The treatment zones are a pre-cleaning zone, at least one cleaning zone, a clear rinsing zone and also a drying zone. In the cleaning zone, loosely clinging dirt is removed from the items to be cleaned. For this purpose, rinsing liquid is drawn through a pump from the storage tank associated with this treatment zone and sprayed over the items to be cleaned through suitably embodied nozzles. Subsequently, the rinsing liquid flows back into the storage tank again, where it is drawn in again by a circulating pump and introduced into a circulating circuit. Conventionally, the storage tank is covered by strainers in order to keep relatively large dirt particles out of the rinsing liquid.

In the at least one cleaning zone adjoining the pre-cleaning zone, dirt particles still clinging to the items for rinsing to be cleaned are removed by means of a conventionally alkaline rinsing liquid. For this purpose, the heated rinsing liquid is drawn out of the storage tank associated with the treatment zone through a further circulating pump and sprayed over the items for rinsing by means of suitably positioned and oriented nozzles. Subsequently, the rinsing liquid flows back into the corresponding storage tank again, where it is drawn in again by the circulating pump. Conventionally, the storage tank is covered by strainers in order to prevent relatively coarse dirt particles from entering the rinsing liquid.

In the clear rinsing zone adjoining the at least one cleaning zone, the alkaline rinsing liquid, which wets the surface of the items for rinsing, is rinsed away together with any remaining food remnants from the surface of the items for rinsing by means of hot fresh water to which a clear rinsing aid is generally added. In specific embodiments of the clear rinsing zone, the fresh water is again collected after this treatment step in a storage tank associated with this treatment zone and drawn in using a circulating pump associated with this treatment zone and distributed over the items for rinsing by the actual fresh water clear rinsing by means of nozzles (pump clear rinsing). Subsequently, the rinsing liquid flows back into the storage tank again, where it is drawn in again by the circulating pump.

The volume of water that is supplied to the described dishwasher in the clear rinsing zone flows over by means of overflows, merely as a result of the action of gravity between the storage tanks of the individual zones, in each case from zone to zone and in this way renews the contents of each of the storage tanks. An overflow, which guides the excess water to the channel system, is located in the first tank of the machine (pre-rinsing zone). Each storage tank comprises a suitable means, i.e. for example a manually operable drain valve which serves to empty each storage tank.

DE 10 2005 008987 B3, which corresponds to U.S. Publication No. 2008/0041419, and which is incorporated herein by reference, discloses a dishwasher having in each treatment zone, in relation to the above-described embodiment, a filter that is used to continuously filter the cleaning fluid located in the respective storage tank. In addition, this design of a dishwasher has pumps between the individual storage tanks of the respective zones, so that the water which is supplied to the dishwasher in the clear rinsing can be pumped into the storage tank of the further treatment zones in a controlled and targeted manner. In addition, each of the storage tanks of this machine has its own electrically driven component for emptying the tank, i.e. a pump.

At the end of an operating cycle, i.e. for example at the end of a working day, the above-described dishwashers are generally emptied and thoroughly cleaned. This is necessary in order to allow hygienic operation of the dishwasher. This cleaning is normally carried out in such a way that the doors or flaps with which each treatment zone is equipped are opened. The storage tank of each zone is then emptied using the means provided for this purpose, i.e. for example using the manual drain valves or if appropriate the pumps. Furthermore, all the strainers are removed from the tanks and cleaned by hand outside the machine using water. The interior of the individual treatment zones is generally sprayed out and rinsed out with water by hand with the aid of a hose with a spraying device. Dirt, i.e. for example food remnants, starch deposits and rims of fat, etc. which have accumulated in the interior of the zones during the rinsing operation, are removed in this way and rinsed into the channels through the outflow openings of the individual storage tanks. The water which is used for this purpose is generally tap water, optionally heated tap water, without the addition of cleaning agents.

A drawback of a conventional procedure reside in the fact that thorough cleaning and rinsing-out of the individual treatment zones of the dishwashers uses up a large amount of fresh water. This is due partly to the fact that water is conventionally used without the addition of cleaning agents and the dirt in the treatment zones at the end of a day contains for example also fat-type components which have to be rinsed away. This additionally promotes the above-described consumption of fresh water. The quality of the cleaning carried out in this way is very highly dependent on the person performing the task, i.e. on how conscientiously he carries out the cleaning. In order to perform the activity or to visually inspect the result of the cleaning, the cleaner has to bend or squeeze into the respective treatment zone through the door of the dishwasher; this is not advantageous for ergonomic reasons.

As a manual cleaning requires the doors of the individual treatment zones to be left open and these doors are very frequently embodied as upwardly movable sliding doors, the back or the inner side of these doors cannot be sprayed down; instead, the back or the inner side of doors of this type is very difficult to clean. Depending on the manner in which the jet of water from the spraying device strikes walls or built-in parts in the treatment zone, this jet is reflected and sprays back in the direction of the cleaner, as a result of which, viewed globally, the result of the conventional cleaning process to be carried out by hand is, after the end of the working day, highly dependent on subjective influences, very inconvenient to carry out and is above all very time-consuming.

Solutions are known in which attempts are made, by way of additional equipment measures, to eliminate or at least to alleviate the drawbacks outlined hereinbefore. Thus, for example, a solution is known according to which a nozzle system, which is fed via a separate pump, is arranged on the ceiling of each storage tank. The separate pump is supplied from the pump clear rinsing storage tank. This water is still relatively clean even at the end of a working day. While or after the water is let out or pumped out from the remaining storage tanks, the water from the pump clear rinsing storage tank can now be used to spray down the ceilings of the storage tanks. The dripping water is then no longer collected, but runs in the channels. The drawback of this procedure resides in the fact that the amount of water in the pump clear rinsing storage tank is highly limited. The pump clear rinsing storage tank conventionally has merely a volume of about 30 l, so that the automated cleaning effect is also extremely limited as a result of the one-off use of this amount.

Furthermore, solutions are known that seek to reduce the drawbacks described hereinbefore by way of additional procedural measures. Thus, there are for example machines in which, after the above-described manual emptying and initial cleaning of the strainers, the tanks of the machine are refilled, heated up and enriched with cleaner. In the machine, which is reprepared in this way for operation using clean water, the circulating pumps of all the tanks are started up again and the inner side of the machine is sprayed down with clean washing liquor. The drawback of this procedure resides in the fact that a very large amount of additional water, cleaner and energy has to be used up in order to reprepare for operation the machine as a whole at the end of an operating cycle. In addition, the filling and heating-up of the storage tanks takes a relatively long time. In the region of the pre-cleaning zone, the cleaning effect will be insufficient using this method, as on the one hand most dirt accumulates here as a result of the operation and on the other hand this zone conventionally has neither a possibility for heating-up nor a possibility for adding cleaners.

SUMMARY OF THE INVENTION

It is therefore an object of the present invention to provide a method in which an automatic automated cleaning of a continuous dishwasher is possible at the end of an operating period, such as for example a working day. Furthermore, the solution proposed in accordance with the invention is based on the object of equipping a continuous dishwasher in such a way that the described method can be carried out for the automatic automated cleaning of the continuous dishwasher therein.

The continuous dishwasher proposed in accordance with an embodiment of the invention comprises a filter on each of the storage tanks and has, in addition to the circulating pumps for carrying out the actual rinsing process, further pumps between the individual storage tanks of the respective treatment zones for the items for rinsing. Thus, the water which is supplied to the continuous dishwasher within the pump clear rinsing, for example, can be pumped into the storage tank of the respectively preceding treatment zone in a controlled and targeted manner. In an advantageous manner, the continuous dishwasher configured in accordance with the invention, in which each treatment zone contains a filter that can be used to continuously filter the cleaning fluid located in the respective storage tank, displays the property that the cleaning fluid in the individual storage tanks is still relatively clean even at the end of an operating cycle. In accordance with the treatment sequence, the first tank, i.e. for example the storage tank of the pre-rinsing zone (pre-clean up), contains the most dirt remnants; in each further storage tank following this storage tank, as viewed in the direction of conveyance of the items to be cleaned, the degree of soiling decreases. The pump clear rinsing zone contains the, in relative terms, cleanest water which, in the described case of continuous fine filtering, contains almost no suspended matter.

Now, this grading of the water quality may be advantageously utilized in order that relatively clean water contained in one of the treatment zones is used to clean the respectively preceding treatment zone which is dirtier as a result of the method. Based on the total number of treatment zones of a continuous dishwasher with a plurality of storage tanks, this takes place as follows:

Firstly, the most heavily soiled tank within a pre-rinsing zone is completely emptied. For this purpose, a fine filter is back-rinsed and the concentrate contained therein is guided into the outflow of the channels; any residual water remaining in the tank is likewise fed into the outflow, i.e. the channels, via an emptying device. A fine filter, which is arranged in a second storage tank, is subsequently back-rinsed and its concentrate is guided into the first tank. As a result, the second storage tank is emptied, whereas the first storage tank is refilled.

The procedure is exactly the same with each tank following the second storage tank in the direction of conveyance, so that the last tank, i.e. for example the storage tank, of the pump clear rinsing zone is available empty with a rinsed fine filter. In the following step of the method proposed in accordance with the invention, the last storage tank is filled up with fresh water. This water can be pre-heated and originate for example from the mains positioned on the building side or from a built-in boiler of the machine and be enriched with cleaning agent or clear rinsing agent.

The addition of a clear rinsing agent has in particular the advantage that all the inner faces of the continuous dishwasher are sprayed with clear rinsing solution at the end of the complete method sequence; this particularly promotes the rinsing-away of dirt remnants.

Now, the renewed cleaning liquid, which is located in each treatment zone or each storage tank, is circulated for a specific time, i.e. for example during a period of time of from 60 s to 120 s, through the circulating pump associated with the respective treatment zone.

Dirt remnants located in the respective treatment zone are rinsed away from all the inner faces by means of the rinsing systems and nozzles provided and are collected in the fine filter. The method cycle recommences after this cleaning process.

The storage tanks are successively emptied as described above; at the same time, the filters of the individual storage tanks are rinsed and each tank is refilled with clean cleaning solution from the subsequent tank. In contrast to the preceding method, the pump clear rinsing storage tank is now no longer filled. Its inner sides are wetted by the fresh water and accordingly cleaned sufficiently well. In a subsequent rinsing step, the storage tanks, which are still filled with liquid, are rinsed out again as described hereinbefore. This cycle is now repeated again, with the difference that the second-to-last tank is now not refilled either.

The method cycles described hereinbefore are repeated until finally only the first tank of the continuous dishwasher is still filled with cleaning liquid. The first tank is rinsed out for a final time; the fine filter is likewise back-rinsed for a final time and the tank is then emptied. At the end of this method sequence, all the storage tanks, all the fine filters and also all the inner faces of the treatment zones of the machine have been completely internally cleaned several times with in each case water which is always clean, using a filling of the pump clear rinsing tank corresponding to about 30 l of water. If required, the first step, in which the pump clear rinsing storage tank positioned last in the direction of transportation is filled, can be repeated several times before the further steps, in which the machine is successively emptied, ensue. Before the beginning of the automated sequence, it may be necessary to remove coarse strainers which are provided from the continuous dishwasher, to clean them by hand and subsequently to reinsert them into the machine.

At the end of the automated method proposed in accordance with the invention, all that remains to be done is to remove filter on the emptying devices from the storage tanks and to shake them out by hand. The advantages of the method, in particular the automated method, proposed in accordance with the invention reside in the extremely economical use of the resources, be it fresh water, be it heat energy, be it cleaning agents, because these are beneficially used several times. A further advantage of the method proposed in accordance with the invention may be identified in the fact that, as a result of the described cascade principle for self-cleaning, heated rinsing liquid with cleaner is also introduced in the pre-rinsing zone (pre-clean up). During the rinsing operation, this zone runs cold and without the addition of cleaner; on the other hand, soiling is likely to be heavy here in particular. In a further advantageous manner, precisely this heavily soiled zone is internally cleaned with the most cycles. Viewed globally, the method proposed in accordance with the invention provides, using relatively few raw materials and relatively little labor and time, automatic, effective cleaning of a continuous dishwasher containing a plurality of storage tanks at all the inner faces with consistently high quality.

In order to improve in an advantageous manner the effect of the method proposed in accordance with the invention, each of the treatment zones of the dishwashers is equipped with additional nozzles. The nozzles are designed in such a way as to allow all the inner faces of the respective zones to be sprayed with cleaning liquid. For this purpose, the outlet openings of the nozzle heads are oriented or positioned accordingly. In addition, these nozzle heads also apply a sufficient amount of cleaning liquid to the inner sides of the closed doors. Either these nozzle heads are attached directly to the washing systems of the respective zones or special nozzles or washing systems, which reach and wet all the inner faces, are built into the individual treatment zones.

Either the aforementioned nozzle heads or nozzles or washing systems are supplied with cleaning liquid directly from the respectively built-in circulating pump of the treatment zone or special pumps are provided that are activated accordingly for implementing the self-cleaning function. In an advantageous manner, the inner faces of the machines are embodied in a smooth-faced manner and without narrow gaps and corners in order to improve the cleaning result. In a further configuration of the solution proposed in accordance with the invention, the ceiling of each storage tank is designed with a downward gradient, so that all the remnants of the cleaning liquid introduced in the automated cleaning cycle flow away effectively. Any coarse strainer systems and also the floors of the storage tanks are designed in such a way that all the residual liquids are guided to the respective outlet device. The inner sides or backs of the doors are for example profiled with a herringbone-like pattern, as a result of which an accumulation of the liquid film formed on the surface is achieved and detached dirt can be optimally washed away without manual intervention of an operator being required after the automated cleaning cycle proposed in accordance with the invention has been carried out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
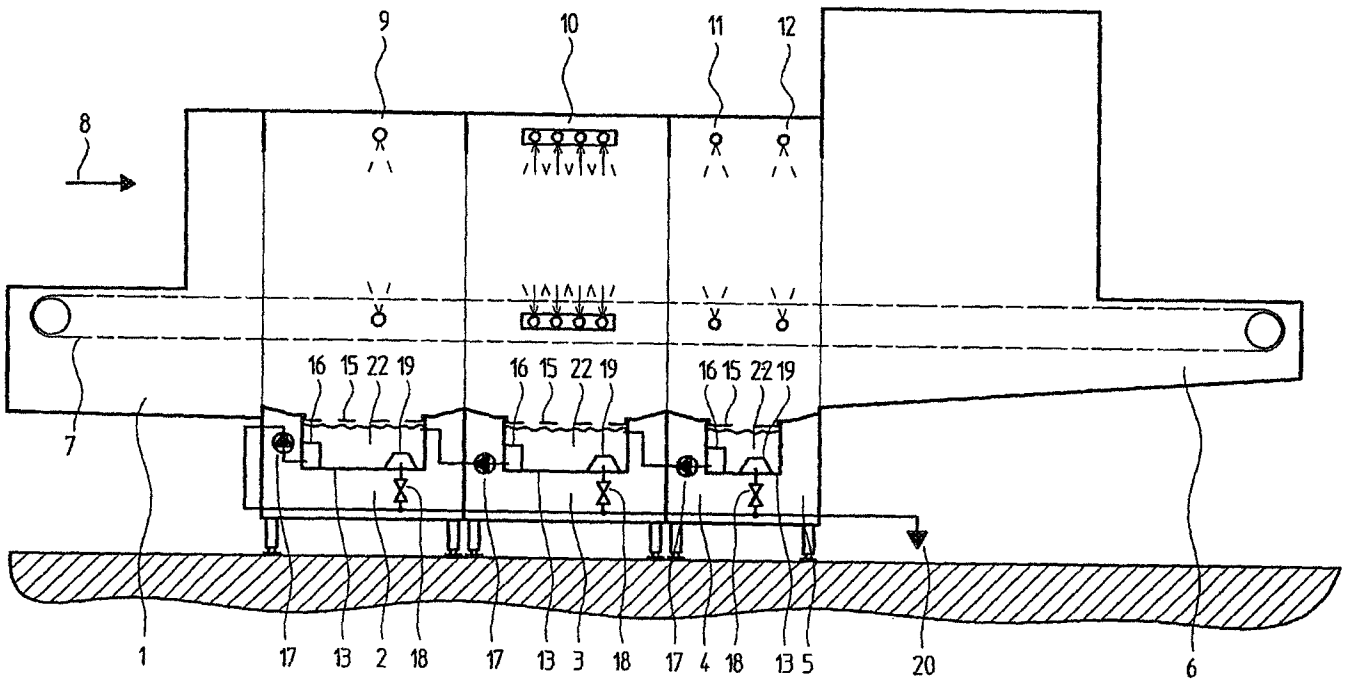
FIG. 1 is a schematically represented illustration of an embodiment of a continuous dishwasher.

The illustration according to FIG. 1 is a schematically represented variant embodiment of a continuous dishwasher proposed in accordance with the invention having a number of storage tanks corresponding to the number of treatment zones. A section in the longitudinal direction of the continuous dishwasher proposed in accordance with the invention may be seen in the illustration according to FIG. 1.

The continuous dishwasher is shown without items for cleaning; this is generally the situation at the end of the rinsing operation after an operating period. The storage tanks of individual rinsing zones 2, 3 and 4 are filled with soiled cleaning fluid, the degree of soiling of which differs. Furthermore, a transporter 7 for the items to be cleaned is illustrated schematically. In the illustration according to FIG. 1, the transporter 7 is designed by way of example as a conveyor chain. However, other variants of the transporter 7 can also be used. A transporter, in which the items to be cleaned are conveyed during operation through the individual rinsing zones 2, 3, 4 of the continuous dishwasher, is denoted by reference numeral 8.

An inlet 1 is followed in the direction of transportation 8 by a pre-rinsing zone 2 with its at least one rinsing system 9. Viewed in the direction of transportation 8, the pre-rinsing zone 2 is adjoined by a main washing zone 3 with at least one rinsing system 10 associated therewith. The main washing zone 3 is adjoined, viewed in the direction of transportation 8, by a pump clear rinsing zone 4 which likewise has at least one rinsing system 11. Finally, the pump clear rinsing zone 4 is followed by a fresh water clear rinsing zone 5 which likewise has at least one rinsing system 12.

The method proposed in accordance with the invention can also be carried out using a continuous dishwasher, in particular a continuous dishwasher whose treatment zones for the items to be cleaned are constructed in a combination and/or number differing from that recited hereinbefore.

Furthermore, the illustration according to FIG. 1 shows that the individual treatment zones 2, 3, 4 each have storage tanks 13 which are covered by coarse strainers 15—to take an example. The coarse strainers 15 keep relatively coarse dirt away from the cleaning fluid which is respectively stored in the storage tanks 13. A fine filter 16 and also a pump 17 for rinsing the fine filter 16 are associated with each of the storage tanks 13; likewise, each of the storage tanks 13 of the individual treatment zones has an emptying device 18. The circulating pumps 14 associated with the individual treatment zones 2, 3, 4—apart from the fresh water clear rinsing zone—are not shown in FIG. 1. The illustration according to FIG. 1 does not contain a filling component 21 for the fresh water clear rinsing zone 5 either.

Each of the aforementioned treatment zones 2, 3, 4 and 5 of the continuous dishwasher has at least one nozzle or nozzle head which is designed in such a way as to allow cleaning liquid to be applied to all the inner faces of the respective treatment zones 2, 3, 4 and 5. The nozzles or the nozzle heads are oriented in such a way that no non-wetted face portions remain. In addition, a sufficient amount of the inner sides of the closed doors, via which the individual treatment zones are accessible from the outer side, is also wetted with cleaning liquid through the nozzles or the nozzle heads. Either the nozzles or nozzle heads are attached directly to the washing systems 9, 10, 11 and 12 of the respective treatment zones 2, 3, 4, 5 or special nozzles or washing systems allowing all the inner faces of the respective treatment zone to be sprayed are built into the treatment zones 2, 3, 4 and 5.

Either these nozzles or washing systems are supplied with cleaning liquid directly from the respectively built-in circulating pump of the respective treatment zone 2, 3, 4 and 5 or special pumps are provided for carrying out the self-cleaning. Preferably, the inner faces of the treatment zones 2, 3, 4 and 5 of the continuous dishwasher are designed in a smooth-faced manner, without narrow gaps and corners. The ceiling of each of the storage tanks 13 is designed with a downward gradient in such a way that all the remnants of the respectively sprayed cleaning liquid can flow away effectively. Any coarse strainer systems 15 and the floors of the storage tanks 13 are designed in such a way that all the liquid remnants remaining in the storage tanks are guided to the respective outlet device. The inner sides or backs of the doors 24 allowing access to the respective treatment zones 2, 3, 4 and 5 are preferably profiled with a herringbone-like pattern. As a result, an accumulation of the liquid film formed on these faces can be achieved, so that partially dissolved dirt can be optimally washed away in the direction of the tanks.

Figure 2A:
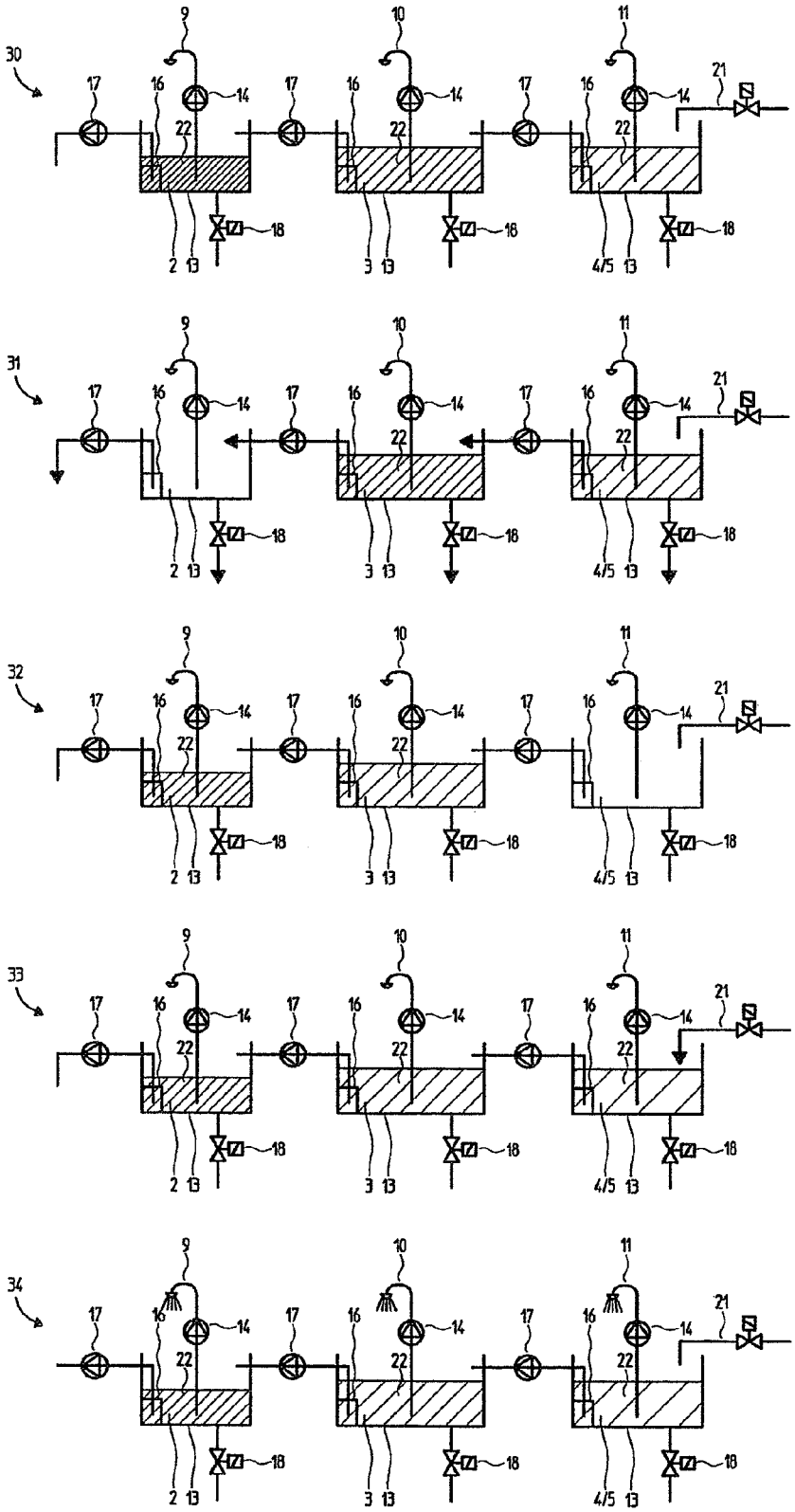
FIGS. 2*a* and 2*b* are a diagram of the method sequence proposed in accordance with the invention in different stages of the method.
Figure 2B:
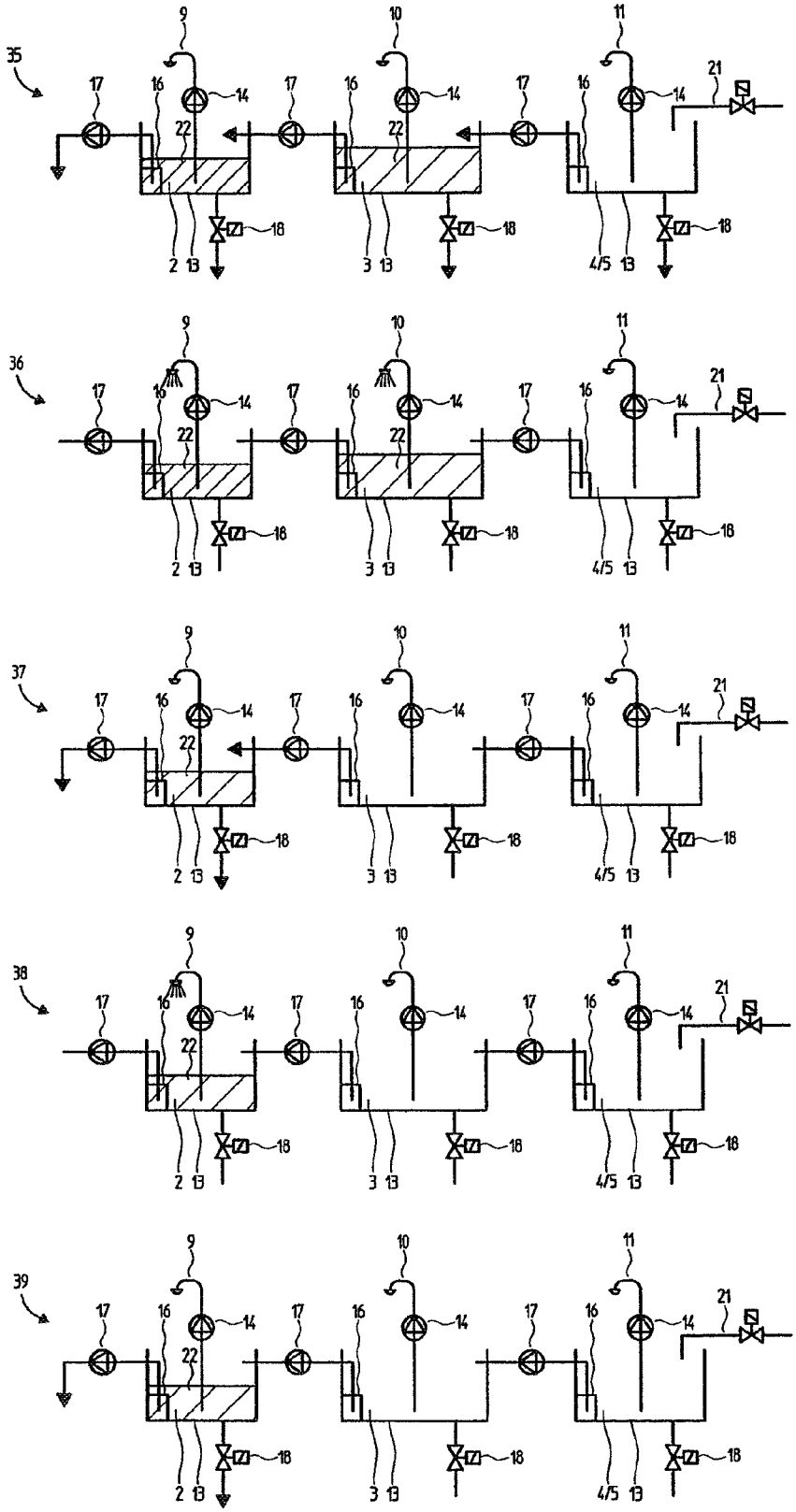

The illustrations according to FIGS. 2*a* and 2*b* show different stages of the sequence of the automated cleaning method proposed in accordance with the invention in specific operating states. The method proposed in accordance with the invention proceeds cyclically; the individual steps within a cleaning cycle are indicated by reference numerals 30 to 39.

Reference numeral 30 denotes the starting situation at the end of an operating period, i.e. after the end of the rinsing operation. All of the storage tanks 13 of the individual rinsing zones 2, 3, 4 and 5 are filled with used cleaning fluid 22. The cleaning fluid is soiled most heavily in the first zone 2, i.e. the pre-rinsing zone, and least heavily in the zone 4, i.e. in the pump clear rinsing zone. As a result of the fine filter 16, which is permanently operative during operation of the continuous dishwasher, the soiling of the cleaning fluid 22 is relatively low at the end of the rinsing operation. In FIGS. 2*a* and 2*b*, a high degree of soiling of the cleaning fluid is marked by narrow shading and a low degree of soiling of the cleaning fluid 22 is marked by wider shading. An emptying device 18 is associated with each of the storage tanks 13 of the pre-rinsing zone 2 of the main rinsing zone 3 and also the fresh water or pump clear rinsing 4, 5. The storage tank 13 of the pump clear rinsing or fresh water clear rinsing zone 4, 5 can be filled with fresh water by the filling component 21.

A pre-rinsing system 9 or rinsing systems 10 and 11 are associated with each of the tanks 13, the cleaning fluid 22, which is present in the respective tanks 13 at different degrees of soiling, being conveyed into the respective pre-rinsing and rinsing systems 19 and 11 respectively via circulating pumps 14. Furthermore, each of the storage tanks 13 has a coarse strainer 15 (not shown) and also a fine filter 16. Cleaning fluid 22 is pumped over from one of the storage tanks 13 to a storage tank 13 positioned respectively downstream via pumps 17.

Reference numeral 31 identifies a first step of a cycle of the automated cleaning method proposed in accordance with the invention. The most heavily soiled storage tank 13 of the pre-rinsing zone 2 is completely emptied. For this purpose, the fine filter 16 is back-rinsed with the aid of the pump 17 and the concentrate which is present in the fine filter 16 is guided into the outflow. Cleaning fluid 22 remaining in the storage tank 13 is if appropriate likewise guided into the outflow via the emptying device 18. The fine filter 16 in the storage tank 13 of the main washing zone 3 is subsequently back-rinsed; the concentrate is guided into the storage tank of the pre-rinsing zone 2. As a result, the storage tank 13 of the main washing zone 3 is emptied and the storage tank 13 associated with the pre-rinsing zone 2 is refilled. The storage tank 13 associated with the pre-rinsing zone 2 thus contains cleaning fluid 22 which is heated and is if appropriate enriched with cleaner and also displays a lower degree of soiling identified by the wider shading. This is indicated by the stage 32.

The procedure is the same with each storage tank 13 following—viewed in the direction of transportation 8 of the items to be cleaned—the storage tank 13 of the main washing zone 3 until the last of the storage tanks 13, i.e. for example the storage tank 13 associated with the pump clear rinsing zone 4 or the fresh water clear rinsing zone 5, is available empty with a rinsed fine filter 16. This stage is marked by reference numeral 32.

In the following method step 33, the last of the storage tanks 13, as viewed in the direction of transportation 8, i.e. for example the storage tank 13 associated with the pump clear rinsing zone 4 or the fresh water clear rinsing zone 5, is filled with fresh water. This is carried out via a filling component 21. This water can be pre-heated, i.e. for example be taken from the building-side mains or from the built-in boiler of the continuous dishwasher; if appropriate, the water can be enriched with cleaning agent or clear rinsing agent.

According to method step 34, the renewed cleaning liquid located in each of the treatment zones 2, 3, 4 and 5 or each of these storage tanks 13 is now circulated for a specific period of time, which may for example be between 60 s and 120 s, by a built-in pump 14. This is indicated in stage 34 by the cleaning fluid 22 issuing from the pre-rinsing system 9 or from the rinsing systems 10 and 11. Dirt remnants located in the respective zone 2, 3, 4 and 5 are rinsed away from all the inner faces (for example of the storage tanks 13 and also the inner side of the door allowing access) by means of the rinsing systems 9, 10 and 11 and also nozzles provided and are collected in the fine filter 16.

After this coarse cleaning process, the cycle recommences. The storage tanks 13 are successively emptied as described hereinbefore with reference to method steps 31 and 32; at the same time, the individual fine filters 16 of the individual storage tanks 13 are rinsed and each of the storage tanks 13 is refilled with cleaning fluid 22 displaying a lower degree of soiling from the—viewed in the direction of transportation 8—subsequent storage tank 13, cf. method step 35. The storage tank 13 associated with the pump clear rinsing zone 4 or the fresh water clear rinsing zone 5 is no longer filled. Its inner sides are sufficiently well cleaned by the fresh water supplied in method step 33, so no further cleaning step is required any more.

In a subsequent method step 36, the cleaning fluid 22 of the storage tanks 13 of the pre-rinsing zone 2 and the main washing zone 3 is circulated and rinsed out again, as described hereinbefore. Afterwards, the cleaning fluid 22 is pumped over to a storage tank 13 of the preceding zone viewed in the direction of transportation 8, with the difference that the storage tank 13 of the main washing zone 3 is now not refilled in accordance with method step 37 either. The pumping-over is repeated until finally only the storage tank 13 associated with the pre-rinsing zone 2 is still filled with cleaning fluid 22. The cleaning fluid is finally circulated in method step 38. In method step 39, the storage tank 13 associated with the pre-rinsing zone 2 is emptied; the fine filter 16 is back-rinsed for the last time and the storage tank 13 of the pre-rinsing zone 2 is completely emptied.

At the end of the method sequence described hereinbefore, all the storage tanks 13 and all the fine filters 16 of the continuous dishwasher are completely cleaned several times with in each case cleaner and cleaner cleaning fluid using a filling of the storage tank 13 associated with the pump clear rinsing zone 4 or the fresh water clear rinsing zone 5 (approx. 30 l of water). All that remains to be done is to remove the filter on the emptying devices 18 from the storage tanks 13 and to clean them by hand, i.e. for example to shake them out. If required, the first method step 31 can be repeated several times in conjunction with the filling of the storage tanks 13 of the pump clear rinsing zone 4 or the fresh water clear rinsing zone 5 before the further steps, with successive emptying of all of the storage tanks 13 of the continuous dishwasher, ensue.

Figure 3:
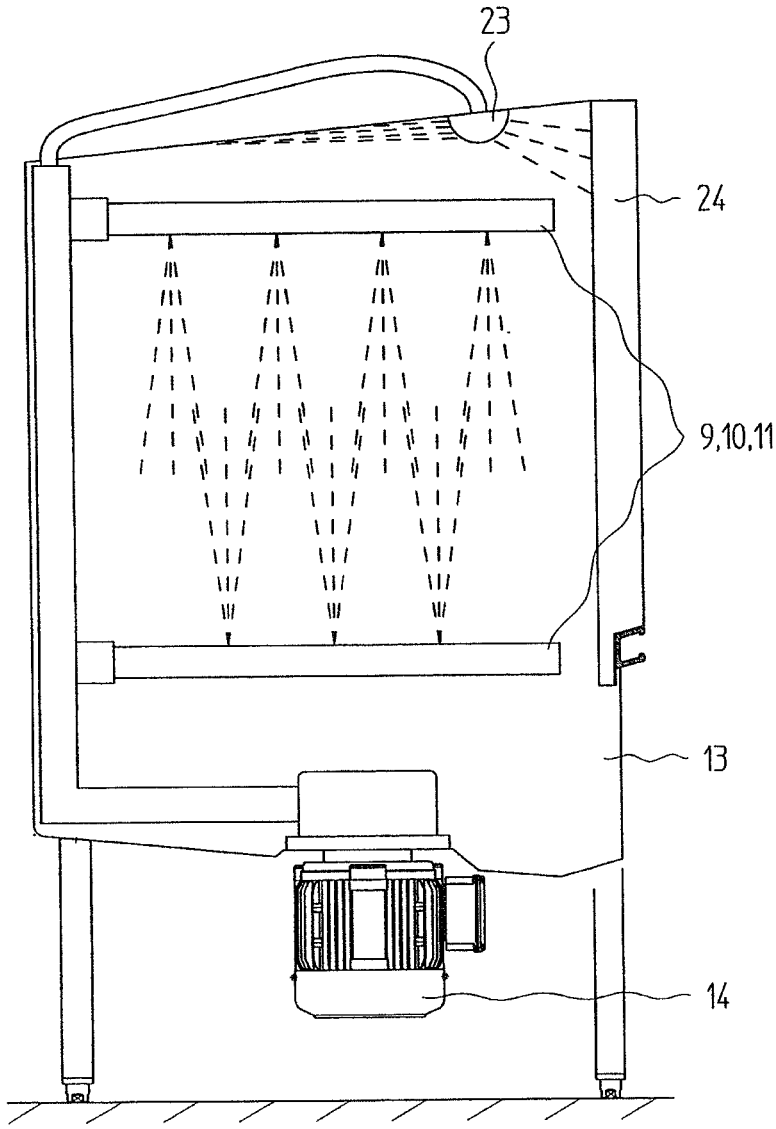
FIG. 3 is a schematic illustration of an independent nozzle head.

FIG. 3 shows that inner sides of the access doors 24 can be wetted by means of an independent nozzle head 23 which is for example mounted in a roof face of one of the treatment zones. As a result, even dirt accumulating in the corners and edges can be detached promptly, so that such dirt does not become caked-on and solidify, but is rinsed away in good time. The independent nozzle heads 23 can be designed in such a way as to have for example a hemispherical nozzle head—as illustrated in FIG. 3—and the nozzles are introduced therein in such a way that wetting of the sides of the treatment zone that are positioned above the rinsing systems 9, 10 and 11, i.e. the ceiling thereof and the inner side of the door 24, can be brushed over at all times with cleaning fluid.

Figure 4:
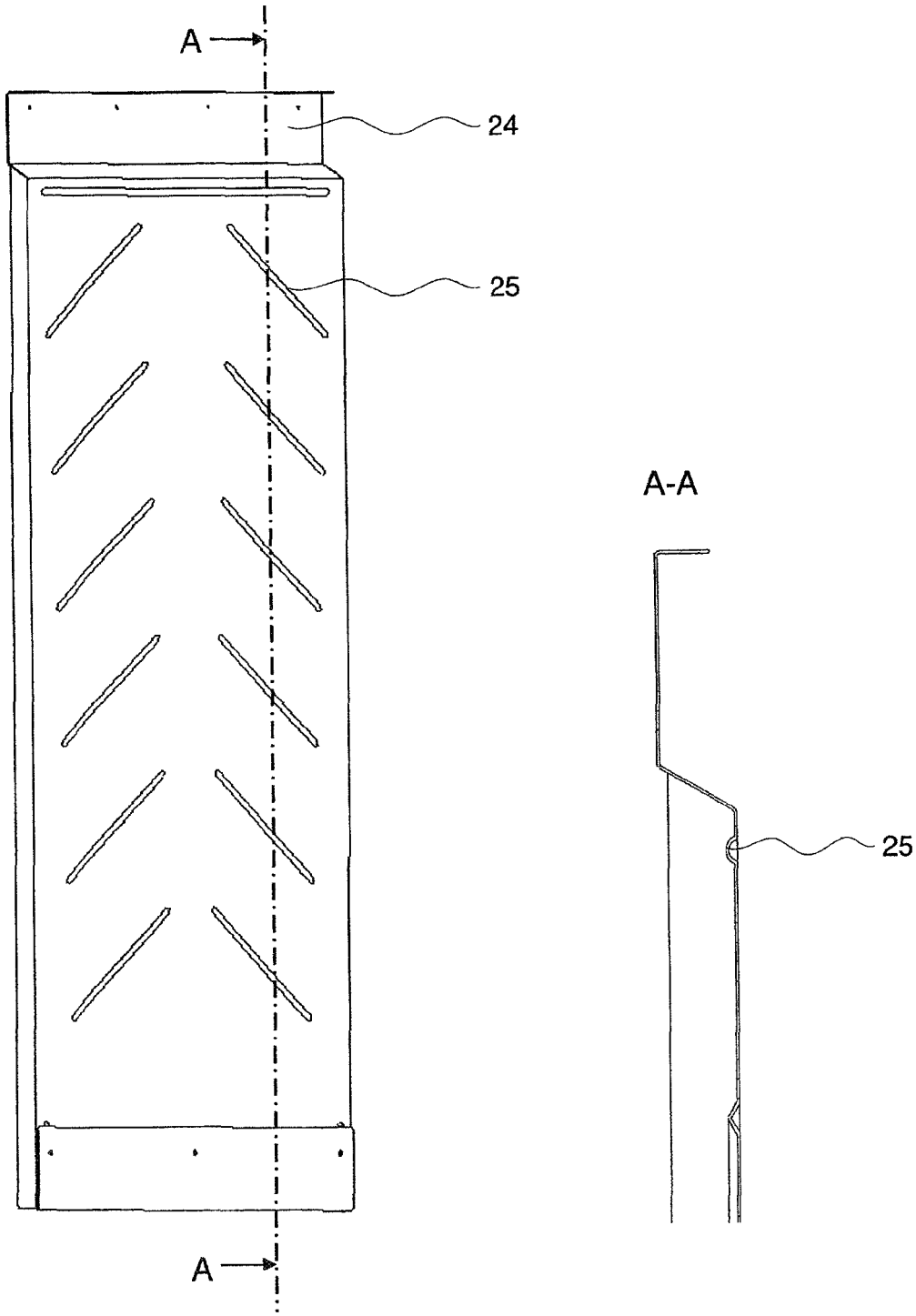
FIG. 4 is a schematic illustration of the profiling of the inner side of the doors.

FIG. 4, cf. section line A-A, shows that a for example obliquely running profile, i.e. a profiling 25—preferably in herringbone form—is arranged on the doors 24 allowing access to the individual treatment zones. In an advantageous manner, the profiling prevents the accumulation of dirt, promotes the running-off thereof under constant wetting, a round configuration, in particular, of the base of the individual profiles of the profiling 25 preventing cleaning fluid from running off or dirt from caking on or becoming fixed.

The profiling 25 is arranged on the inner side of, for example, each of the doors 24 and can for example run at an angle—as in FIG. 4—of 45°. It goes without saying that other angles of inclination may also be selected.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for automated self-cleaning of a continuous dishwasher comprising a prewashing zone, a prewashing storage tank associated with the prewashing zone, a washing zone, a washing storage tank associated with the washing zone, a rinsing zone and a rinsing storage tank associated with the rinsing zone, a transporter for conveying items to be cleaned, a fine filter associated with the prewashing storage tank, the washing storage tank and the rinsing storage tank, a prewashing zone transferring device associated with the prewashing zone, a washing zone transferring device associated with the washing zone and a rinsing zone transferring device associated with the rinsing zone, and at least one automatically acting emptying device for emptying the prewashing storage tank, the washing storage tank and the rinsing storage tank, the method comprising:

(a) storing used cleaning fluid in the prewashing storage tank, the washing storage tank and the rinsing storage tank;

(b) emptying the used cleaning fluid from the prewashing storage tank;

(c) emptying the washing storage tank by transferring the used cleaning fluid from the washing storage tank through the fine filter associated with the washing storage tank to back-rinse the fine filter associated with the washing storage tank and into the prewashing storage tank;

(d) emptying the rinsing storage tank by transferring the used cleaning fluid from the rinsing storage tank through the fine filter associated with the rinsing storage tank to back-rinse the fine filter associated with the rinsing storage tank into the washing storage tank;

(e) filling the rinsing storage tank with fresh water;

(f) circulating the used cleaning fluid in the prewashing storage tank in the prewashing zone to clean interior walls of the prewashing zone, circulating the used cleaning fluid in the washing storage tank in the washing zone to clean interior walls of the washing zone and circulating the fresh water in the rinsing storage tank in the rinsing zone to clean interior walls of the rinsing zone;

(g) passing the used cleaning fluid in a forward direction through the fine filter of the washing storage tank and through the fine filter of the rinsing storage tank during step f; and (h) passing the used cleaning fluid through the fine filter of the washing storage tank and through the fine filter of the rinsing storage tank in a backward direction, opposite to the forward direction, during steps c and d.

2. The method of claim 1 including the additional steps of, subsequent to steps (a)-(f):

i) emptying the prewashing storage tank;

j) emptying the washing storage tank by transferring the used cleaning fluid from the washing storage tank into the prewashing storage tank;

k) emptying the rinsing storage tank by transferring the used water from the rising storage tank to the washing storage tank without refilling the rinsing storage tank; and l) after steps j and k, circulating the cleaning fluid in the prewashing storage tank and the used water in the washing storage tank.

3. The method of claim 2 including the additional steps of, after steps (i) through (l):

m) emptying the prewashing storage tank;

n) after step m, emptying the washing storage tank by transferring the used water from the washing storage tank to the prewashing storage tank;

o) circulating the used water in the prewashing storage tank; and p) emptying the used water from the prewashing storage tank.

4. The method of claim 1, wherein emptying the used cleaning fluid from the prewashing storage tank comprise emptying substantially all the used cleaning fluid from the prewashing storage tank.

5. The method of claim 1, wherein transferring the used cleaning fluid from the washing storage tank to the prewashing storage tank comprises transferring substantially all the used cleaning fluid from the washing storage tank to the prewashing storage tank starting at a time when the prewashing storage tank is substantially empty.

6. A method for automated self-cleaning of a continuous dishwasher comprising a prewashing zone, a prewashing storage tank and a prewashing fine filter associated with the prewashing storage tank, a washing zone, a washing storage tank and a washing fine filter associated with the washing storage tank, a rinsing zone, a rinsing storage tank and a rinsing fine filter associated with the rinsing storage tank, a transporter for conveying items to be cleaned, a first prewashing pump and a second prewashing pump associated with the prewashing zone, a first washing pump and a second washing pump associated with the washing zone, and a first rinsing pump and a second rinsing pump associated with the rinsing zone, and at least one automatically acting emptying device for emptying the prewashing storage tank, the washing storage tank and the rinsing storage tank, the method comprising:

performing at least one item-cleaning cycle by:

(a) pumping cleaning fluid from the prewashing storage tank onto items on the transporter in the prewashing zone using the first prewashing pump, the pumped cleaning fluid from the prewashing storage tank returning to the prewashing storage tank by passing through the prewashing fine filter in a forward direction to become used cleaning fluid in the prewashing storage tank;

(b) pumping cleaning fluid from the washing storage tank onto items on the transporter in the washing zone using the first washing pump, the pumped cleaning fluid from the washing storage tank returning to the washing storage tank by passing through the washing fine filter in the forward direction to become used cleaning fluid in the washing storage tank; and (c) pumping cleaning fluid from the rinsing storage tank onto items on the transporter in the rinsing zone using the first rinsing pump, the pumped cleaning fluid from the rinsing storage tank returning to the rinsing storage tank by passing through the rinsing fine filter in the forward direction to become used cleaning fluid in the rinsing storage tank;

and, after the at least one item-cleaning cycle, performing a dishwasher self-cleaning cycle by:

(d) using the second prewashing pump to empty the prewashing storage tank by pumping the used cleaning fluid in the prewashing storage tank through the prewashing fine filter in a backward direction to back-rinse the prewashing fine filter;

(e) after step d, using the second washing pump to empty the washing storage tank into the prewashing storage tank by pumping the used cleaning fluid in the washing storage tank through the washing fine filter in the backward direction to back-rinse the washing fine filter;

(f) after step e, using the second rinsing pump to empty the rinsing storage tank into the washing storage tank by pumping the used cleaning fluid in the rinsing storage tank through the rinsing fine filter in the backward direction to back-rinse the rinsing fine filter;

(g) after step f, filling the rinsing storage tank with clean water; and (h) after step e, and with the transporter empty, using the first prewashing pump to circulate the used cleaning fluid in the prewashing storage tank in the prewashing zone to clean interior walls of the prewashing zone and using the first washing pump to circulate used cleaning fluid in the washing storage tank in the washing zone to clean interior walls of the washing zone and using the first rinsing pump to circulate the water in the rinsing storage tank to clean interior walls of the rinsing zone.

7. The method of claim 6, further including, after step h, (i) emptying the prewashing storage tank;

(j) after step i, using the second washing pump to empty the washing storage tank into the prewashing storage tank;

(k) after step j, using the second rinsing pump to empty the rinsing storage tank into the washing storage tank; and (l) after step k, using the first prewashing pump to circulate the used cleaning fluid in the prewashing storage tank in the prewashing zone to clean interior walls of the prewashing zone and using the first washing pump to circulate used cleaning fluid in the washing storage tank in the washing zone to clean interior walls of the washing zone while leaving the rinsing storage tank empty.

* * * * *